US010952467B2

(12) United States Patent
Cane et al.

(10) Patent No.: US 10,952,467 B2
(45) Date of Patent: Mar. 23, 2021

(54) MOUTHPIECE AND HEATER ASSEMBLY FOR AN INHALATION DEVICE

(71) Applicant: VENTUS MEDICAL LIMITED, Huntingdon (GB)

(72) Inventors: Michael Cane, Cambridge (GB); Oliver Hart, Cambridge (GB); Mark Dignum, Liverpool (GB); David Lawson, Liverpool (GB)

(73) Assignee: VENTUS MEDICAL LIMITED, Liverpool (GB)

( * ) Notice: Subject to any disclaimer, the term of this patent is extended or adjusted under 35 U.S.C. 154(b) by 50 days.

(21) Appl. No.: 16/493,798

(22) PCT Filed: Mar. 14, 2018

(86) PCT No.: PCT/EP2018/056429
§ 371 (c)(1),
(2) Date: Sep. 13, 2019

(87) PCT Pub. No.: WO2018/167166
PCT Pub. Date: Sep. 20, 2018

(65) Prior Publication Data

US 2020/0128875 A1 Apr. 30, 2020

(30) Foreign Application Priority Data

Mar. 16, 2017 (GB) ..... 1704167
May 26, 2017 (GB) ..... 1708472
Jun. 20, 2017 (GB) ..... 1709864

(51) Int. Cl.
*A24F 40/46* (2020.01)

(52) U.S. Cl.
CPC ..... *A24F 40/46* (2020.01)

(58) Field of Classification Search
CPC ..... A24F 40/46
See application file for complete search history.

(56) References Cited

U.S. PATENT DOCUMENTS

2013/0255702 A1 10/2013 Griffith, Jr. et al.
2014/0060554 A1 3/2014 Collett et al.
(Continued)

FOREIGN PATENT DOCUMENTS

WO 2016005530 A1 1/2016
WO 2016005533 A1 1/2016
WO 2016162446 A1 10/2016

OTHER PUBLICATIONS

International Search Report for PCT/EP2018/056429, dated Jul. 5, 2018.
Written Opinion for PCT/EP2018/056429, dated Jul. 5, 2018.

*Primary Examiner* — James Harvey
(74) *Attorney, Agent, or Firm* — John H. Choi & Associates

(57) ABSTRACT

An inhalation device includes a mouthpiece and a heater having a rigid planar substrate which supports at least one resistive element portion applied over a first region of at least one surface of the substrate, and a pair of contacts each connected to the at least one resistive element portion at one end of the contacts and applied over a second region of the at least one surface of the substrate. The substrate supports an aerosolizable composition deposited on the substrate above the resistive element portion of the heater. The mouthpiece has at least a fluid inlet and a fluid outlet proximate rear and front ends thereof respectively. The heater is disposed within the mouthpiece with at least portions of the contacts being both exposed and accessible so that an electrical connection can be readily achieved when the rear end of the mouthpiece is connected to the inhalation device.

20 Claims, 7 Drawing Sheets

(56) References Cited

U.S. PATENT DOCUMENTS

| | | | | |
|---|---|---|---|---|
| 2017/0164657 | A1* | 6/2017 | Batista | A24F 40/30 |
| 2020/0128875 | A1* | 4/2020 | Cane | A24F 40/46 |
| 2020/0352242 | A1* | 11/2020 | Lawson | A24F 40/46 |

* cited by examiner

MOUTHPIECE AND HEATER ASSEMBLY FOR AN INHALATION DEVICE

CROSS-REFERENCE TO RELATED APPLICATION

This application is a 371 of International Application No. PCT/EP2018/056429, filed on Mar. 14, 2018, which is incorporated by reference in its entirety.

TECHNICAL FIELD

The present invention relates to a mouthpiece and heater assembly for an inhalation device. The heater is configured to heat a composition to generate an aerosol for inhalation by a user. In particular, but not exclusively, the present invention relates to a heater for a nicotine replacement therapy or a smoking-substitute device. Furthermore, the present invention relates to a mouthpiece comprising the heater, an inhalation device comprising the heater and a method of manufacturing the heater.

Although the present application will focus on heating compositions containing nicotine for inhalation by user, it will be appreciated that the heater can be used for heating compositions comprising other compounds, for example, medicaments or flavorings.

BACKGROUND

Nicotine replacement therapies are aimed at people who wish to stop smoking and overcome their dependence on nicotine. One form of nicotine replacement therapy is an inhaler or inhalator, one example of which is sold by Johnson & Johnson Limited under the brand name Nicorette®. These generally have the appearance of a plastic cigarette and are used by people who crave the behavior associated with consumption of combustible tobacco—the so-called hand-to-mouth aspect—of smoking tobacco. An inhalator comprises a replaceable nicotine cartridge. When a user inhales through the device, nicotine is atomized from the cartridge and is absorbed through the mucous membranes in the mouth and throat, rather than travelling into the lungs. Nicotine replacement therapies are generally classified as medicinal products and are regulated under the Human Medicines Regulations in the United Kingdom.

In addition to passive nicotine delivery devices such as the Inhalator, active nicotine delivery devices exist in the form of electronic cigarette which generally use heat and/or ultrasonic agitation to vaporize/aerosolize a formulation comprising nicotine and/or other flavoring, propylene glycol and/or glycerol into an aerosol, mist, or vapor for inhalation. The inhaled aerosol mist or vapor typically bears nicotine and/or flavorings without the odor and health risks associated with combustible tobacco products, and in use, the user experiences a similar satisfaction and physical sensation to those experienced from combustible tobacco products, particularly as regards exhalation because aerosol mist or vapor is of similar appearance to the smoke exhaled when smoking a conventional combustible tobacco product.

The skilled reader should appreciate that the term "smoking-substitute device" as used herein includes, but is not limited to, electronic nicotine delivery systems (ENDS), electronic cigarettes, e-cigarettes, e-cigs, vaping cigarettes, pipes, cigars, cigarillos, vaporizers and devices of a similar nature that function to produce an aerosol mist or vapor that is inhaled by a user. Some substitute devices are disposable; others are reusable, with replaceable and refillable parts. The present invention is primarily concerned with the latter, and particularly with "active" devices which require or possess a source of power in order to effect the aerosolization.

Smoking-substitute devices typically resemble a traditional cigarette and are cylindrical in form with a mouthpiece at one end through which the user can draw the aerosol, mist or vapor for inhalation. These devices usually share several common components: a power source such as a battery, a reservoir for holding the liquid to be vaporized (often termed an e-liquid), a vaporization component such as a heater for atomizing and/or vaporizing the liquid and to thereby produce an aerosol, mist or vapor, and control circuitry operable to actuate the vaporization component responsive to an actuation signal from a switch operative by a user or configured to detect when the user draws air through the mouthpiece by inhaling.

The most common form of active smoking substitute device is known as a wick-and-coil device, an example of which is schematically depicted in FIG. 1. The vaporization component comprises a wick (3), which may be solid or flexible, saturated in e-liquid with a heating coil (5) wrapped around it. The wick-and-coil arrangement is usually disposed inside a fluid-containing reservoir in order that liquid therein can be absorbed by the wick. The complete assembly is often termed a "cartomizer" (being a conflation of the words cartridge and atomizer). In use, an electric current is passed through the coil (5) resistively heating it, such heat being transferred to the e-liquid in the wick (3) causing it to evaporate. The usually soaked wick (3) generally contains more e-liquid than would be vaporized during a single inhalation. This increases the thermal mass of the wick (3) and means that the heat generated by the coil (5) is unnecessarily expended in heating all of the e-liquid rather than the amount that actually needs to be vaporized. Heating surplus liquid reduces the energy efficiency of the device. Furthermore, the coil (5) is spaced apart from the wick (3) to prevent the coil (5) from burning the wick (3). This reduces heat transfer to the wick and means that the coil (5) has to be excessively powered to compensate for the radiative dissipation of heat from the coil and inefficiencies of heating a large substrate and volume of liquid. This again reduces the energy efficiency of the device. Moreover, surplus e-liquid and repeated heating to a higher temperature increases the risk that a user will receive a larger dose of nicotine than intended and increases the potential for degradation of both nicotine and excipients.

Another problem with known e-cigarette heaters is that their design does not lend itself to automation.

A further problem with known e-cigarettes is that a user can refill their device with e-liquids which are not intended for that device and consequently may have higher levels of nicotine or additives which undergo an adverse reaction upon heating. As a result, a user may be exposed to excessive levels of nicotine or potentially harmful by-products.

The popularity and use of smoking-substitute devices has grown rapidly in the past few years. Although originally marketed as an aid to assist habitual smokers wishing to quit combustible tobacco, consumers are increasingly viewing smoking substitute devices as desirable lifestyle accessories. Furthermore the change in regulatory paradigm to that of a tobacco harm reduction one has further boosted consumer uptake of these products. This has caused concern that smoking-substitute devices may be becoming attractive to children, young adults and those currently not engaged in consumption of combustible tobacco products. Furthermore, there is on-going scientific debate about the long-terms effects on health from the prolonged use of smoking-substitute devices and concerns, particularly from healthcare professions, regarding the lack of information available to consumers regarding the use of smoking-substitute devices and associated liquids that prevent them from making informed decisions regarding their use. One area of particular concern is the quality and provenance of many e-liquids currently available on the market.

In response to safety and quality concerns, the European Union has agreed on a revised Tobacco Products Directive (Tobacco and Related Products Regulations 2016). The TPD has introduced regulations applicable to smoking-substitute devices that will:

- limit the risks of inadvertent exposure to nicotine by setting maximum sizes for refill reservoirs, containers, tanks, and cartridges (Article 20.3(a));
- limit the concentration of nicotine in the liquid to 20 mg/ml (Article 20.3(b));
- prohibit the use of certain additives in the liquid (Article 20.3(c));
- require that only high-purity ingredients are used in the manufacture of liquids (Article 20.3(d));
- require that all ingredients (except nicotine) do not pose a risk to human health in heated or unheated form (Article 20.3(e));
- require that all smoking-substitute devices deliver doses of nicotine at consistent levels under normal conditions of use (Article 20.3(f));
- require that all products include child and tamper-proof labelling, fasteners and opening mechanisms (Article 20.3(g)); and
- require that all products meet certain safety and quality standards and to ensure that products do no break or leak during use or refill (penultimate and final sentences, paragraph 41 of the recitals).

However, even despite the introduction of such nicotine dosing control measures on manufacturers and suppliers of nicotine-containing formulations intended for use in electronic cigarettes, wick-and-coil devices are inherently rudimentary and as a result will always suffer significant variability in dose between inhalations. Furthermore, because such devices require refilling by end users over which legal frameworks such as the TPD above inevitably have little or no control, such end users will always be capable of using their own, possibly adulterated liquid formulations, possibly to the detriment of their own health and that of others.

Aspects and embodiments of the invention were devised with the foregoing in mind.

BRIEF SUMMARY OF THE PRESENT INVENTION

In a first aspect, there is provided an assembly for an inhalation device comprising a mouthpiece and a heater, said heater comprising a substrate which supports:

- at least one resistive element portion applied over a first region of at least one surface of said substrate,
- at least a pair of contacts each connected to the at least one resistive element portion at one end of said contacts and applied over a second region of the said at least one surface of said substrate,
- an amount of an aerosolizable composition deposited on the substrate above said first region on said at least one surface thereof or a surface opposite thereto such that heat generated by the resistive heating element is directly or indirectly conducted to the aerosolizable composition to cause at least some aerosolization thereof, said mouthpiece being provided with at least a fluid inlet and a fluid outlet proximate rear and front ends thereof respectively, fluid communication means being provided internally of said mouthpiece between said inlet and said outlet, characterized in that the heater is disposed substantially within the mouthpiece with at least portions of the contacts being both exposed and accessible to facilitate the making of an electrical connection with said contacts when the rear end of the mouthpiece is connected to said inhalation device, and further characterized in that the substrate surface on which the aerosolizable composition has been deposited is disposed within or adjacent said fluid communication means such that when fluid is flowing therein and aerosolization of the composition is simultaneously occurring, the aerosol generated is entrained in the fluid flowing through said fluid communication means.

An advantage of using a heater to heat the composition compared to the medicinal inhaler or inhalator devices of the prior art described above is that the formulation can be specifically designed to deliver the compound of interest either to the lung or to the buccal cavity. For compositions containing nicotine, this means that the user experiences an enhanced "hit", i.e. an increased rate of absorption of nicotine. Consequently, this may assist in allaying a craving for nicotine more quickly, with fewer inhalations, thereby helping a user to gradually reduce their intake of nicotine.

A further advantage of the heater of the present invention compared to, for example, the heater of a conventional e-cigarette, is that the composition can be placed in direct contact with the substrate and thus be conductively heated. Heat is conductively transferred from the resistive element portion directly into the composition. In one particular embodiment in which the heater is applied to one surface of the substrate and the composition applied to another opposite surface of the substrate, but in the same general region thereof as that of the other surface over which the heater is applied, the heat from the heater is first conducted through the material of the substrate before being conductively transferred directly into the composition. In both cases, there is no space for an air gap between the composition and the heater. This means that the heater can vaporize the required amount of liquid at much lower temperatures compared to the wick-and-coil heaters of the prior art. This increases energy efficiency and reduces degradation of the heater.

When a composition is provided on the heater, the heater is configured to heat the composition so that at least a proportion of the composition vaporizes or aerosolizes. The skilled person should understand that an "aerosolized composition" and cognate expressions thereof appearing herein are not limited to an aerosol per se but may also comprise a proportion of the composition in the vapor phase.

Furthermore, the amount of composition deposited on the heater can be carefully controlled so that the heater only heats the necessary amount of composition. Therefore, the energy lost, for example, by heating the excess e-liquid in an e-cigarette is eliminated. As a result, the heater of the present invention has a much lower thermal mass and requires less energy to heat than the heaters of the prior art. This benefit combined with lower heated temperatures assists in increasing the efficiency of the device. Furthermore, this avoids the repeated heat-cool cycle observed in e-cigarettes which may lead to in-use instability of formulation and formation of toxicants.

Preferably, the first region is more proximate a forward or leading edge of the substrate, and the second region more proximate a rearward or trailing edge of said substrate, and the substrate is disposed within the mouthpiece with the rearward or trailing edge substantially adjacent the rear end of the mouthpiece.

Preferably, at least portions of the contacts are exposed and accessible towards the rear end of the mouthpiece.

In the embodiment where the composition is deposited on the same surface of the substrate to that to which the heater has been applied, the heater, or the at least one resistive element portion thereof, may further comprise a barrier layer for inhibiting undesirable by-products generated during the heating of the resistive element portions from mixing with the composition.

Depending on how they are formed, some resistive heaters release undesirable bi-products when they are heated by the application of an electric current. For example, materials or chemicals which are added to the resistive heater during manufacture are sometimes released as volatiles which may react with other chemicals during heating to form potentially harmful by-products. It is preferable that a user does not inhale these by-products. The barrier layer assists in inhibiting undesirable by-products generated during the heating of the at least one resistive heater from mixing with the composition or aerosolized composition by providing a physical barrier or obstacle between the resistive heater and the composition.

Optionally, the barrier layer may be formed of a material selected from one or more of a ceramic, a plastic and glass. These materials have been found to be suitable at providing an effective barrier layer.

In an alternative embodiment, where the composition is deposited on an opposite surface of the substrate to that to which the heater has been applied, the substrate itself provides a barrier to prevent undesirable by-products of heating from mixing with the composition.

The heater may comprise at least two contacts supported by the substrate, wherein a first end of each of the at least two contacts is connected to the resistive element portion and a second end of each of the at least two contacts is arranged to be connectable to an electric power source. This allows the second end of each of the two contacts to be connected to a power source which is separate or remote from the substrate. For example, the second ends could form part of a connector which is configured to connect to a complementary connector that in turn is connected to a power source.

The application of the resistive element portion and the contacts to one or other surface of the substrate may be achieved by a variety of different techniques, such as screen printing, thin and/or thick film printing, laser ablation, or some combination of these techniques. An advantage of printing the resistive element portion and/or contacts is that it is cost-effective and automatable, which contrasts with the slow manual process of winding a coil around a wick.

Optionally, the at least one resistive element portion and contacts may be formed of the same material but the at least one resistive element portion has a smaller cross-sectional area than the contacts such that it has a higher resistance. This allows the resistive element portion and contacts to be deposited in a single print run.

Optionally a part of the material deposited during the single print run may be ablated, for example by laser etching, to form at least one resistive element portion having a region of reduced cross-sectional area such that the region of reduced cross-sectional area has a relatively higher resistance than the remainder of the material. This step reduces the printing step to a single print run over the entire area to be occupied by the resistive element portion such that any detail or finishing required can be provided later by the ablating step.

Alternatively, the at least one resistive element portion and contacts may comprise different materials and be deposited on the substrate using separate print runs. This provides flexibility in the process and allows the properties of the resistive element portion and conductors to be modified by modifying the proportions of various material constituents contained therein.

The at least one resistive element portion may have a length longer than the straight-line distance between the points where the at least one resistive element portion is connected to the contacts. This increases the resistance of the resistive element portion. The resistance of the resistive heater can be controlled by changing the length of the resistive element portion.

Optionally, the at least one resistive element portion may follow a meandering path between the conductors. This has been found to provide a space-efficient configuration of the at least one resistive element portion.

Optionally, the at least one resistive element portion comprises one of carbon or other elements such as silver, ruthenium, palladium. Carbon has been found to have suitable resistive properties for the heater of the present invention. Silver on the other hand has a relatively high temperature coefficient of resistance compared to carbon, and the use of resistive element portions comprising silver results in a greater increase in resistance compared to the use of carbon alone. This makes it easier to monitor changes in resistance and hence the temperature of the resistive element portion.

Optionally, the heater resistive element portions may have a resistance of between 5 ohms and 15 ohms at a temperature of 130° C. This has been found to be a particularly suitable resistance for the resistive element portions and the temperature represents a relatively low operating temperature compared to, for example, a conventional e-cigarette. This resistance range also enables energy to be input to the heater using a standard lithium polymer battery whilst enabling differentiation in resistances between temperatures.

The heater may comprise a plurality of resistive element portions and a corresponding number of contacts. This provides flexibility as to which heaters are activated at any one time.

Optionally, the conductors may comprise a contact for each of the plurality of resistive element portions and a further contact which forms a common ground for each of the plurality of resistive elements portions. This provides a space-efficient arrangement on the substrate.

The substrate may be substantially rigid, and substantially planar. This assists in reducing deformation of the substrate during heating of the resistive element portion and allows a force to be applied to the substrate to help with inserting the substrate into an inhalation device.

Optionally, the substrate may comprise a material selected from one or more of a ceramic, a plastic or glass. These materials have been found to be particularly suitable for the substrate of the present invention at least in terms of their thermal and mechanical properties.

The substrate may comprise an indentation, formed for example by laser cutting, in the region surrounding the at least one resistive element portion or plurality of resistive element portions. The indentation reduces the cross-sectional area of the substrate in the region surrounding the resistive element portion thereby reducing heat transfer away from the resistive element portion through the substrate. This reduces the thermal mass (i.e. the amount of the substrate which needs to be heated during a heating cycle) of the part the substrate underlying the resistive heater, which means that less energy is required to heat this part of the substrate. Accordingly, the energy efficiency of the heater is increased. The indentation may also serve to prevent migration of formulation from the resistive heater area.

The at least one resistive element portion or at least one of the contacts may have a region of reduced cross-sectional area such that the reduced cross-sectional area region acts as a fuse which fails if the electric current flowing through the reduced cross-sectional area region exceeds a certain threshold value. The fuse acts as a safety device which prevents overheating of the heater. The fuse also acts as a failsafe in the event other safety precautions fail, for example, in the event the electronic or software control of an aerosol generation device fails. This assists in the heater complying with the strict safety regulations in place for medical devices.

The deposition of the aerosolizable composition on the substrate may occur at the time of manufacture using, for example, screen printing techniques such that the substrate is provided both with a heater and already charged with a composition to be aerosolized. The composition could comprise a predetermined number of doses. Optionally, the composition may comprise nicotine.

The mouthpiece may comprise first and second parts, which may be detachably connected to one another. The first mouthpiece part may include a slot or recess to receive the heater. The heater may be held in place within the first mouthpiece part by the attachment of the second mouthpiece part thereto. The attachment of the first and second mouthpiece parts may be achieved by means of snap fit connectors provided one or both of the first mouthpiece part and the second mouthpiece part. The mouthpiece is ideally releasably attachable to the main body part.

In most preferred embodiments, the fluid communication means provided internally of the mouthpiece which connects the inlet with the outlet, and the at least one resistive element portion of the heater is arranged in the vicinity of an outlet of said airflow channel. This reduces the length and/or surface area of the airflow channel on which the aerosolized composition could condense, if indeed an aerosolized composition has time to reach the internal surfaces of the airflow channel before exiting through the outlet.

The airflow channel may comprise rails for holding the heater within the interior of the airflow channel. The airflow channel may comprise first and second portions between which the heater may be disposed such that air flowing within the first portion flows over and above the surface of the heater on which the composition has been deposited, and air flowing within the second portion flows underneath the heater, beneath and over the opposite surface of the substrate to that one which the composition has been deposited.

The first and/or second airflow channel portion may be defined by at least one flat surface, which assists in creating a laminar airflow past the heater thus inhibiting the aerosolized composition from contacting the internal surfaces of the airflow channel.

The airflow channel may include a constriction orifice for restricting the flow of air therewithin. Employing a constriction orifice within the airflow channel results in a pressure drop within the airflow channel and may permit the velocity of the airflow to be controlled more accurately (e.g. by the Venturi effect) in the region of the constriction orifice allowing airflow over the heater to travel faster compared to the airflow entering the mouthpiece. The constriction orifice also restricts the flow of air through the airflow channel which provides a similar user experience to inhaling through a conventional cigarette.

Optionally, the constriction orifice may be located upstream of the heater. This provides time and space to assist the turbulent air exiting the constriction orifices in returning to laminar flow by the time it passes over the heater.

Optionally, both the first and second airflow channel portions may comprise a constriction orifice, and ideally the dimensions and fluid flow characteristics are selected such that the airflows in the first and second airflow channel portions are similar, i.e. air flowing in a channel portion is travelling at generally the same speed and mass flow rate.

The mouthpiece and heater assembly may together form a replaceable consumable item which, when new, comes already charged with a composition, and which can be simply disposed of when all the composition initially present has been aerosolized and the consumable item is thus spent.

In a further aspect of the present invention, there is provided an inhalation device comprising the above-described mouthpiece and heater assembly, a main body part, the main body part comprising: a power source for the device; and a control unit.

Such an inhalation device may provide controlled and accurate dosing, would require minimal maintenance (e.g. no cleaning of the mouthpiece is necessary), and would be more hygienic (e.g. reduces build-up of residues from previous use within the inhalation device). Such an inhalation device may also maintain a more consistent level of performance (e.g. avoid blockages within the mouthpiece) since the mouthpiece can be replaced.

The main body part of such an inhalation device may additionally include a fluid inlet and fluid outlet in communication with one another, the latter of which cooperates with the fluid inlet of the mouthpiece when connected to the main body part thus completing the airflow channel.

Optionally, the main body part fluid inlet may be located proximate the end of said main body part free to which the mouthpiece is attached.

BRIEF DESCRIPTION OF THE DRAWINGS

One or more specific embodiments in accordance with aspects of the present invention will be described, by way of example only, and with reference to the following drawings in which.

DETAILED DESCRIPTION OF THE INVENTION

Figure 1:
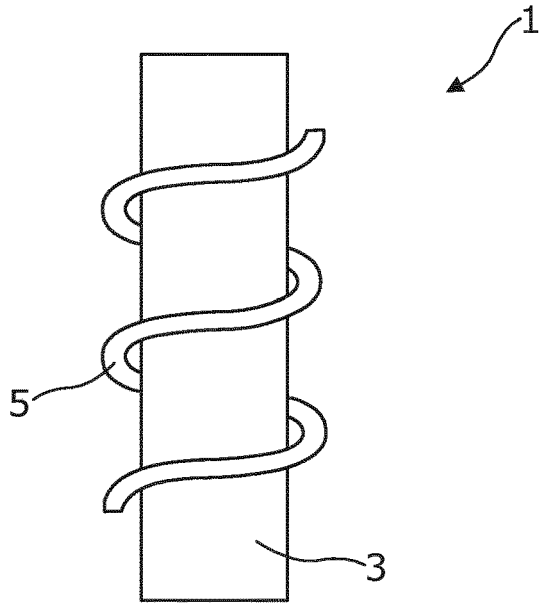
Fig. 1 (Prior Art)
FIG. 1 is a schematic diagram of a prior art e-cigarette wick-and-coil heater.
Figure 2:
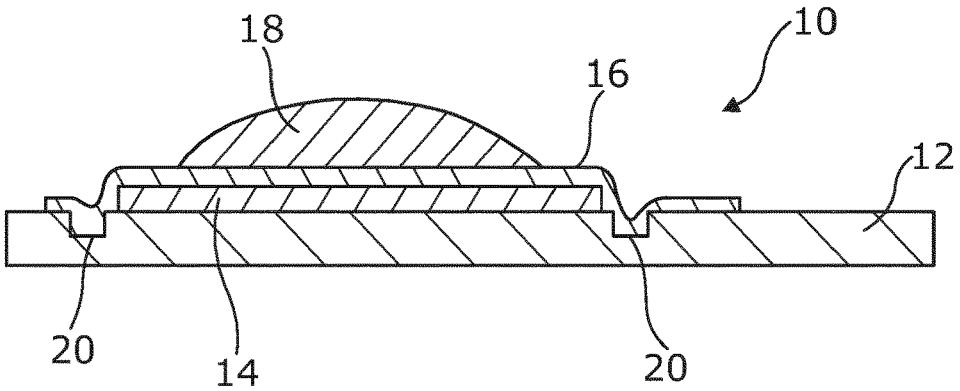
FIGS. 2 and 2A provide cross-sectional views of heaters in accordance with different embodiments of the present invention wherein an amount of a composition is deposited on, firstly, the same surface of the substrate as that over which the heater is applied, and secondly on the opposite surface as that over which the heater is applied.

FIG. 2 shows a heater 10 for an inhalation device according to the present invention comprising a substrate 12 and a resistive heating element 14, which is supported by a portion of the substrate 12. The resistive element portion is connectable to an electric power source (not shown) by means of contacts (not shown). A barrier layer 16 overlies the resistive element portion 14 and part of the substrate 12. The heater 10 is shown with an amount of composition 18 which has been deposited on the barrier layer 16.

When an electric current flows through resistive element portion 14 the temperature of the resistive element portion 14 increases and heat is transferred through the barrier layer 16 to the composition 18. At least a portion of the composition 18 vaporizes and is dispersed into the air above the heater 10. As the composition 18 evaporates away from the heater it cools and some of the vaporized composition condenses to form liquid droplets of composition suspended in air, i.e. an aerosolized composition. This aerosolized composition can be inhaled by a user.

The barrier layer 16 provides a seal over the resistive element portion and part of the substrate, which inhibits undesirable by-products that may be generated when the resistive heater element is heated from mixing with the composition 18 or evaporating and mixing with the aerosolized composition which is inhaled by a user.

Indentations 20 have been formed in the substrate 12 near to either side of resistive heater element 14. Although not shown in the cross-section of FIG. 2, it will be appreciated that indentations 20 extend in a direction into and out of the plane of the cross-section to form a trench on either side of resistive element portion 14. Further indentations (not shown) may also be formed parallel to the plane of the cross-section near to the other two sides of the resistive element portion 14. Indentations or trenches are therefore formed in the region surrounding the at least one resistive element portion 14. The indentations 20 reduce the cross-sectional area of the substrate 12 and hence heat transfer through the substrate in the region of the indentations 20. This provides a degree of thermal isolation for the region of the substrate 12 underlying the resistive element portion 14 and inhibits heat being dissipated throughout the whole of the substrate 12. This reduces the volume of the substrate 12 being heated by the resistive element portion 14 during any particular heating cycle, i.e. the thermal mass of the heater 10. As less heat is dissipated in the substrate 12, more heat is transferred to the composition 18, thereby improving the thermal efficiency of the heater 10.

The heater 10 can be manufactured by providing a substrate 12 and forming indentations 20 in the region where the resistive element portion 14 will be supported, for example, by using a laser cutting process. A resistive element portion 14 can then be deposited in the region surrounded by the indentations 20 using a screen printing process. This deposits a thick film of conductive ink having a suitable resistance on the substrate. If contacts (not shown) are to be provided on the substrate, these can also be deposited on the substrate 12 using a screen printing process. Screen printing provides a cost-effective and automatable method of depositing the resistive element portion and contacts. The contacts will have a higher conductivity than the resistive element portion 14. An etching process may be used to finalize the outline of the screen printed features.

Substrate 12 is made from a ceramic. However, the skilled person will appreciate that materials such as a plastic or glass or a combination of the aforementioned materials may be used. The dimensions of the substrate are 15 mm long by 10 mm wide and 0.5 mm thick, which is relatively small compared to the wick-and-coil heaters of a conventional pre-cigarette. This reduces the thermal mass of the heater 10 and helps to improve thermal efficiency. The skilled person will appreciate that the substrate can have other suitable dimensions.

The conductive ink used to form the resistive element portion 14 comprises carbon particles and silver particles. Other constituents may comprise a resin or binder and a solvent. However, the skilled person will appreciate that other mixtures can be used.

The conductive ink used to form contacts comprises conductive particles, e.g. metallic particles. However, the skilled person will appreciate that other types of particles can be used, e.g. graphite particles.

The above compositions of the conductive inks may be adapted to a particular screen printing process or to achieve a desired resistance for a particular orientation/layout of resistor shape or size.

Once the resistive heater element 14 and contacts have been screen printed on the substrate 12, the heater will generally undergo a heating process in which any volatile solvents are driven off. The heater may then undergo a sintering process at a higher temperature to sinter the conductive or resistive constituents of the conductive inks.

The barrier layer 16 is made from a layer of glass, which is thermally welded to the substrate 12 and resistive element portion 14. However, the skilled person will appreciate that barrier layer 16 can be made from any suitable material which forms an effective seal against the egress of undesirable volatile by-products such as a ceramic or a plastic or a combination of any of the aforementioned materials.

In addition, a composition to be aerosolized can also be deposited on the heater 10 during manufacture such that a heater is provided already pre-charged with a composition. Such composition can also be screen printed onto the heater 10.

Figure 2A:
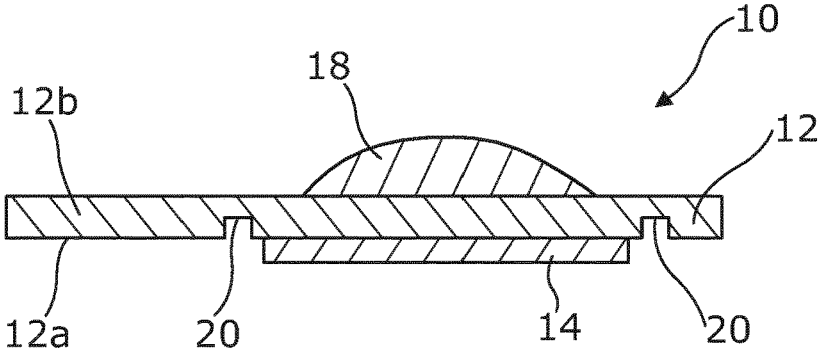

By contrast, in FIG. 2A (in which like reference numerals have been used to those of FIG. 2 to signify like parts), a heater 10 is shown in inverted orientation with the resistive element portions of the heater now provided on a bottom, downwardly facing surface 12*a* of the substrate 12, i.e. a first surface of the substrate, and an amount of composition 18 has been deposited on a top or upwardly facing surface 12*b* of the substrate 12, i.e. an opposing second surface. In this arrangement, the substrate itself provides a barrier between the composition 18 and the resistive element portions 14 of the heater, although heat therefrom is still directly conducted through the substrate 12 into the composition to cause aerosolization thereof and for the aerosol so created to be dispersed into the air above. Again, indentations 20 may be formed in the substrate 12 near to either side of resistive element 14.

As mentioned previously, various types of conductive ink can be used to form the resistive element portions and contacts. For example, carbon-based ink can be used to form the resistive element portions, whereas ink comprising conductive elements such as metals or graphite can be used to form the contacts. Other constituents may comprise a solvent to enable such inks to be printed. In addition, one ink can be used to print both the resistive element portions and the contacts. Ceramic and glass inks both contain a glass phase which provides the resistivity, and metallic phases which provide the conductivity and high temperature coefficient of resistance. The metallic phase may comprise elements such as, for example, silver, ruthenium, palladium or other suitable metals. The above compositions of the conductive inks may be adapted to a particular screen printing process or to achieve a desired resistance for a particular orientation/layout of resistor shape or size. Once the resistive heater element portions 14 and contacts have been printed on the substrate 12, the substrate and printed heater will then generally undergo a heating process to evaporate or vaporize the solvents, after which a further heating process may be used to sinter the metals and melt the glass.

Figure 3:
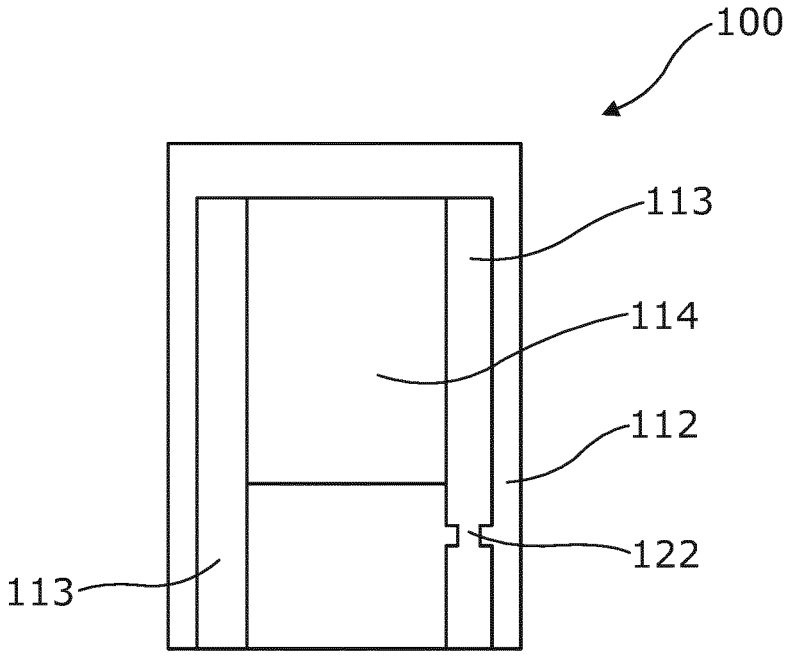
FIG. 3 is a schematic plan view of a heater in accordance with an embodiment of the present invention.
Figure 4:
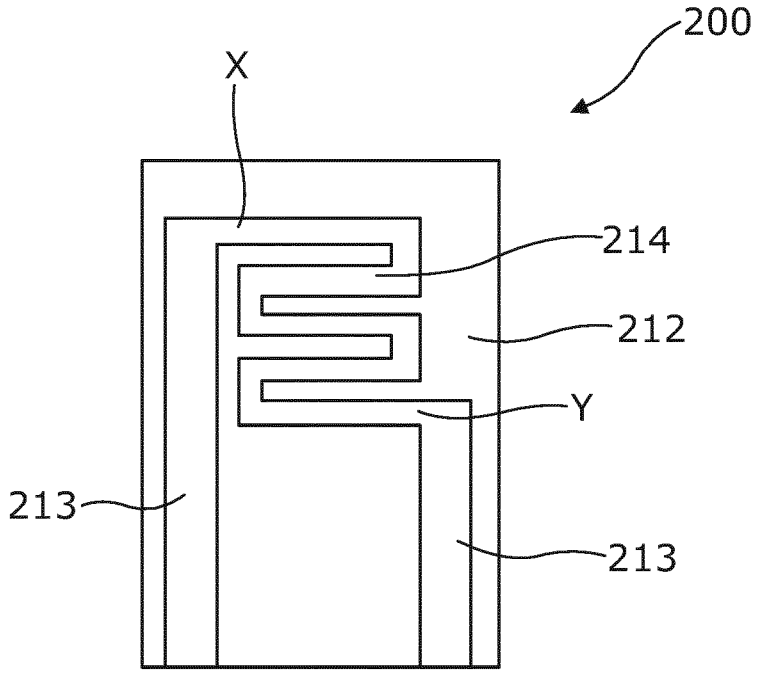
FIG. 4 is a schematic plan view of a heater in accordance with another embodiment of the present invention.

FIGS. 3 and 4 show further embodiments of heaters according to the present invention which can be made using different manufacturing processes. It should be noted that these figures show simplified schematic views. Certain features such as the indentations and the barrier layer have been omitted for clarity. However, the skilled person will appreciate that such omitted features, and other features, could be used with these described embodiments also.

Referring firstly to FIG. 3, a heater 100 comprises a substrate 112, a resistive element portion 114 and two contacts 113. The resistive element portion 114 and contacts 113 are formed of different materials, i.e. they have different compositions, for example the compositions described above, such that the contacts 113 are more conductive than the resistive element portion 114. Consequently, the resistive element portion 114 and contacts are deposited in separate print runs. One print run will deposit a more resistive conductive ink to form the resistive element portion 114 and another print run will deposit a more conductive ink to form the contacts 113. Either the resistive element portion 114 can be deposited first and the contacts 113 second or vice versa.

One of the contacts 113 of the heater 100 has a region of reduced cross-sectional area 122 which acts as a fuse and fails if the electric current flowing through this region exceeds a certain threshold value. Producing the region of reduced cross-sectional area can be done as part of the printing process by simply printing this pattern onto the substrate, thereby negating the need to add a further component to the heater 100. Alternatively, the fuse can be formed using an ablative process such as laser cutting. The fuse acts as a safety device and prevents the heater 100 from overheating.

Referring to FIG. 4, a heater 200 comprises a substrate 212, a resistive element portion 214 and contacts 213. The resistive element portion 214 and contacts 213 are formed of the same material, i.e. the same conductive ink. This conductive ink will generally be more conductive than the conductive ink used to print a standalone resistive heater element or may comprise a composition having a conductivity between the two compositions described above. The resistive element portion 214 is formed by providing a printed track of conductive ink having a smaller cross-sectional area or thinner width or thickness than the remainder of the printed track such that it has a higher resistance. The remainder of the printed track, i.e. the part having the larger cross-sectional area or wider width or thickness forms the contacts 213.

The resistance of the resistive element portion 214 can also be increased relative to the resistance of the contacts 213 by making the resistive heater element longer than the straight-line distance between the points X and Y where the resistive element portion 214 is connected to the contacts 213. This is achieved by giving the resistive element portion 214 a meandering or undulating pattern.

As a result of the resistive element portion 214 and contacts 213 being formed of the same material, these features can be deposited on the substrate 212 in a single print run. The pattern of the resistive element portion 214 can either be printed onto the substrate or the resistive heater element 214 can be printed as a larger block and the pattern achieved by ablating a part of the resistive heater block, for example, using a laser etching or cutting process.

In FIGS. 3 and 4, contacts 113 and 213 extend to and terminate at an edge of the substrates 112 and 212 respectively. This arrangement means that the heaters 100 and 200 are connectable to an electric power source (not shown) which is separate from or remote to the heater. For example, the edge of the substrates 112 and 212 could be inserted into a connector so that the contacts 113 and 213 make electrical contact with connections to an electric power source.

Figure 5A:
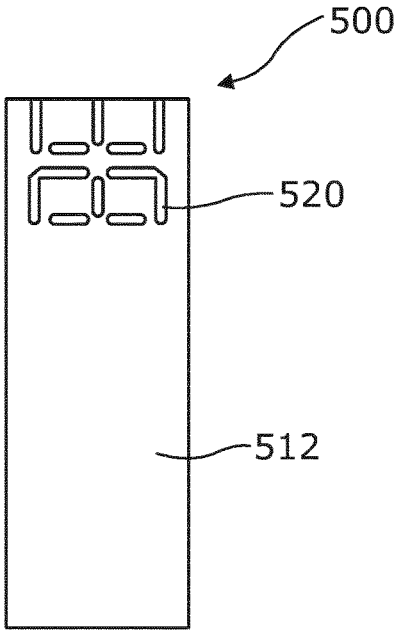
FIGS. 5A-5D are plan views of a heater in accordance with an embodiment of the present invention during various stages of manufacture.

FIGS. 5A-5D show a heater of the present invention during various stages of manufacture. Referring firstly to FIG. 5A, a heater 500 comprises a substrate 512 having a series of indentations 520 formed in a surface of the substrate 512. The heater 500 is configured to support four resistive heater elements (not shown in FIG. 5A) arranged in a 2×2 configuration at one end of the substrate 512. The indentations 520 are arranged in the region surrounding each of the resistive element portions. Not all the indentations 520 are joined together such that there is a gap between some of the indentations in which gap the substrate 512 has its full thickness. This is to avoid overly weakening the substrate 512 in the region of the four resistive element portions. The indentations 520 could be formed by a suitable ablative process for example laser etching or cutting.

Figure 5B:
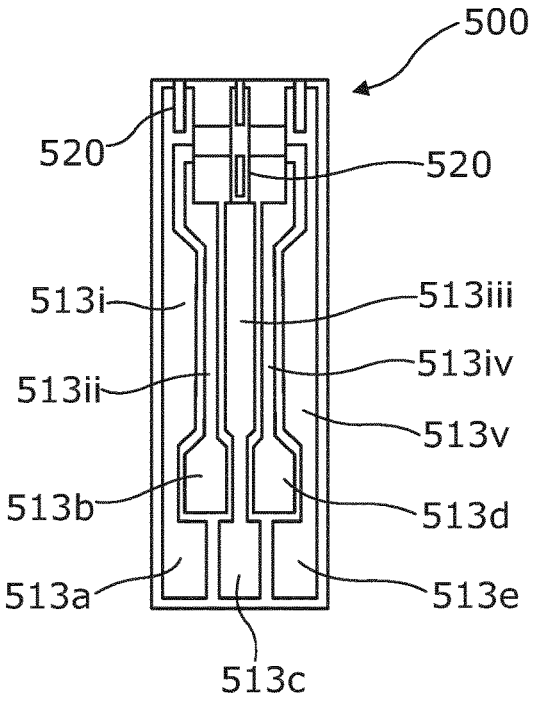

FIG. 5B shows the substrate of FIG. 5A in which an arrangement of contacts 513*i*-513*v* is supported on the substrate 512. The contacts 513*i*-513*v* have been deposited using a screen printing process. A first end of each of the contacts 513*i*-513*v* is arranged to be connected to the resistive element portions (not shown in FIG. 5B) at one end of the substrate 512. Conductor 513*iii* is configured as a common ground connection and is arranged to be connected at its first end to each of the resistive element portions. Conductor 513*iii* is arranged in the middle of the contacts 513*i*-513*v* and resistive heater elements as this is the most convenient arrangement whereby it can be connected to each of the resistive element portions. Contacts 513*i*, 513*ii*, 513*iv* and 513*v* are arranged to be connected at their first ends to a respective one of each of the four resistive element portions.

A second end of the contacts 513*i*-513*v* terminates in a respective series of contact pads 513*a*-513*e* at an end of the substrate 512 opposite the end where the resistive heater elements are located. Contact pad 513*c* is configured to be connectable to a common ground or negative potential of an electric power source such that each of the resistive heater elements can be connected to a ground potential via conductor 513*iii*. Contact pads 513*a*, 513*b*, 513*d* and 513*e* are configured to be connectable to a an electric power source such that a potential difference can be generated across each of the resistive element portions via one of contacts 513*i*, 513*ii*, 513*iv* and 513*v* and common ground conductor 513*iii*.

Figure 5C:
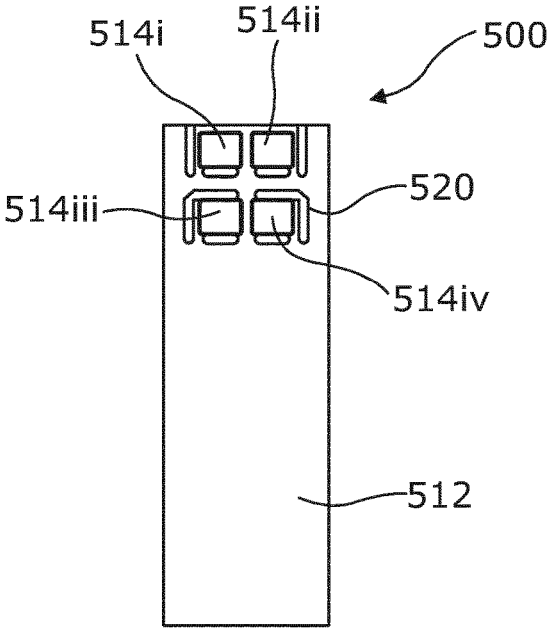

FIG. 5C shows a substrate 512 supporting four resistive heater elements 514*i*-514*iv*. Contacts 513*i*-513*v* have been omitted for the sake of clarity. Resistive heater elements 514*i*-514*iv* are arranged in a 2×2 pattern at one end of the substrate 512. Each of resistive element portions 514*i*-514*iv* is surrounded by a formation of indentations 520. The resistive element portions 514*i*-514*iv* have been deposited using a screen printing process.

Figure 5D:
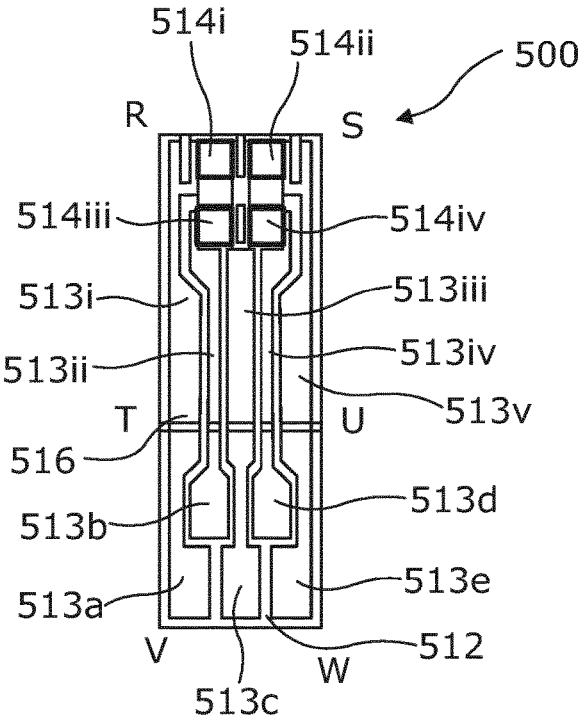

FIG. 5D shows a fully assembled heater 500 comprising a substrate 512, contacts 513*i*-513*v*, resistive element portions 514*i*-514*iv*, a barrier layer 516 and a composition containing nicotine (not shown) deposited on each of the resistive element portions 514*i*-514*iv*. Each of the resistive element portions 514*i*-514*iv* has been connected across a respective one of the contacts 513*i*, 513*ii*, 513*iv* and 513*v* and the common ground conductor 513*iii*. When a potential difference is generated across one of the resistive heater elements 514*i*-514*iv* an electric current flows through the resistive element portion, thereby activating the resistive element portion and causing its temperature to increase. For example, applying a positive potential to contact pad 513*a* and a ground or negative potential to contact pad 513*c* activates resistive heater element 514*i* and causes it to generate heat. Each of the resistive element portions 514*i*-514*iv* is therefore independently activatable by applying a positive potential to any one of contact pads 513*a*, 513*b*, 513*d* and 513*e* and a ground potential to contact pad 513*c*.

The barrier layer 516 provides a seal over the resistive element portions 514*i*-514*iv* and part of the contacts 513*i*-513*v*. The barrier layer 516 extends over an area of the heater 500 denoted by points RSTU in FIG. 5D. The area of the heater denoted by points TUVW is not covered by the barrier layer so not to insulate the contact pads 513*a*-513*e* and allow these to make an electrical connection to an electric power source.

The nicotine containing compositions (not shown) are deposited on top of the barrier layer 516 above each of the resistive element portions 514*i*-514*iv*. The compositions contain 0.5 mg of nicotine in total (at 40% concentration). A screen printing process has been used to deposit the compositions, although the skilled person will appreciate that other methods of deposition could be used. The amount of nicotine containing composition deposited above each of the resistive element portions 514*i*-514*iv* may comprise a single or multiple doses of nicotine per inhalation.

Figure 6:
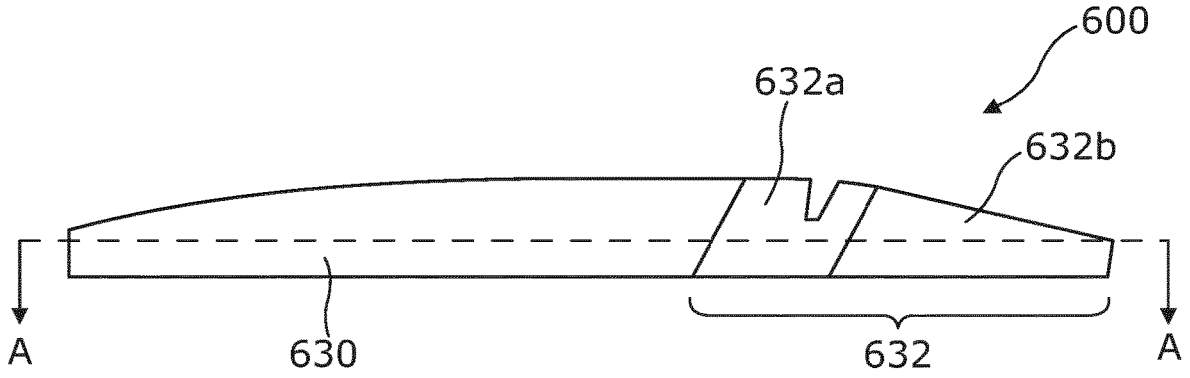
FIG. 6 is a side view of an inhalation device in accordance with an embodiment of the present invention.

FIG. 6 shows an inhalation device 600 according to one embodiment of the present invention comprising a main body part 630 and a mouthpiece 632. The mouthpiece 632 is releasably attachable to the main body part 630. Furthermore, the mouthpiece 632 is formed of separate first 632*a* and second 632*b* parts which are assembled during manufacture. However, the skilled person will appreciate that the inhalation device 600 can also be formed from a single piece, e.g. a single tube.

Figure 7A:
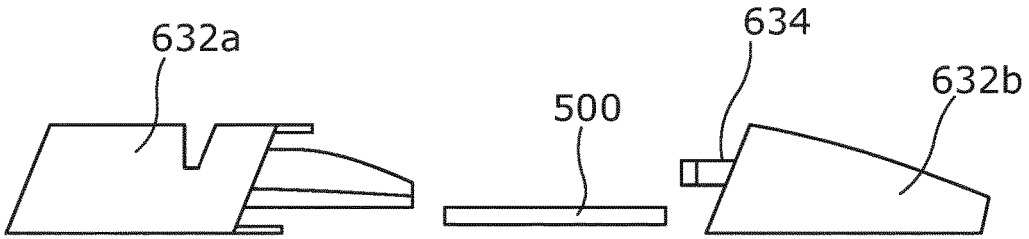
FIGS. 7A and 7B are side views of a mouthpiece for the device of FIG. 6 shown in disassembled and assembled form respectively.

FIG. 7A shows the mouthpiece 632 in disassembled form. First mouthpiece part 632*a* has a slot or recess (not shown) for receiving the heater 500 of FIG. 5D. During manufacture, heater 500 is inserted into the slot or recess of the first mouthpiece part 632*a* and is held in place by the attachment of the second mouthpiece part 632*b* to the first mouthpiece part 632*a*. The second mouthpiece part 632*b* is attached to the first mouthpiece part 632*a* by means of snap fit connectors 634 on either side of the second mouthpiece part 632*b*.

Figure 7B:
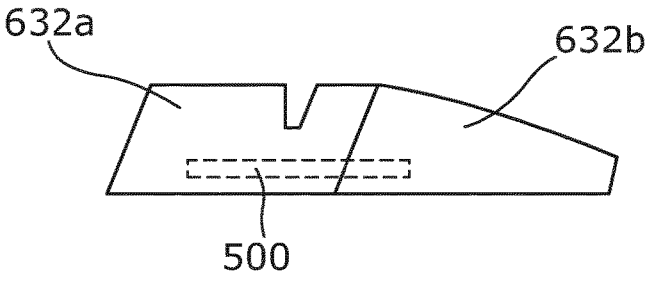

FIG. 7B shows the mouthpiece 632 in assembled form. Heater 500 is held securely within the mouthpiece 632. As described above, heater 500 comprises nicotine containing compositions deposited on the resistive element portions and therefore the mouthpiece 62 comprises a replaceable consumable which can be releasably connected to the main body part 630 of inhalation device 600.

Figure 8:
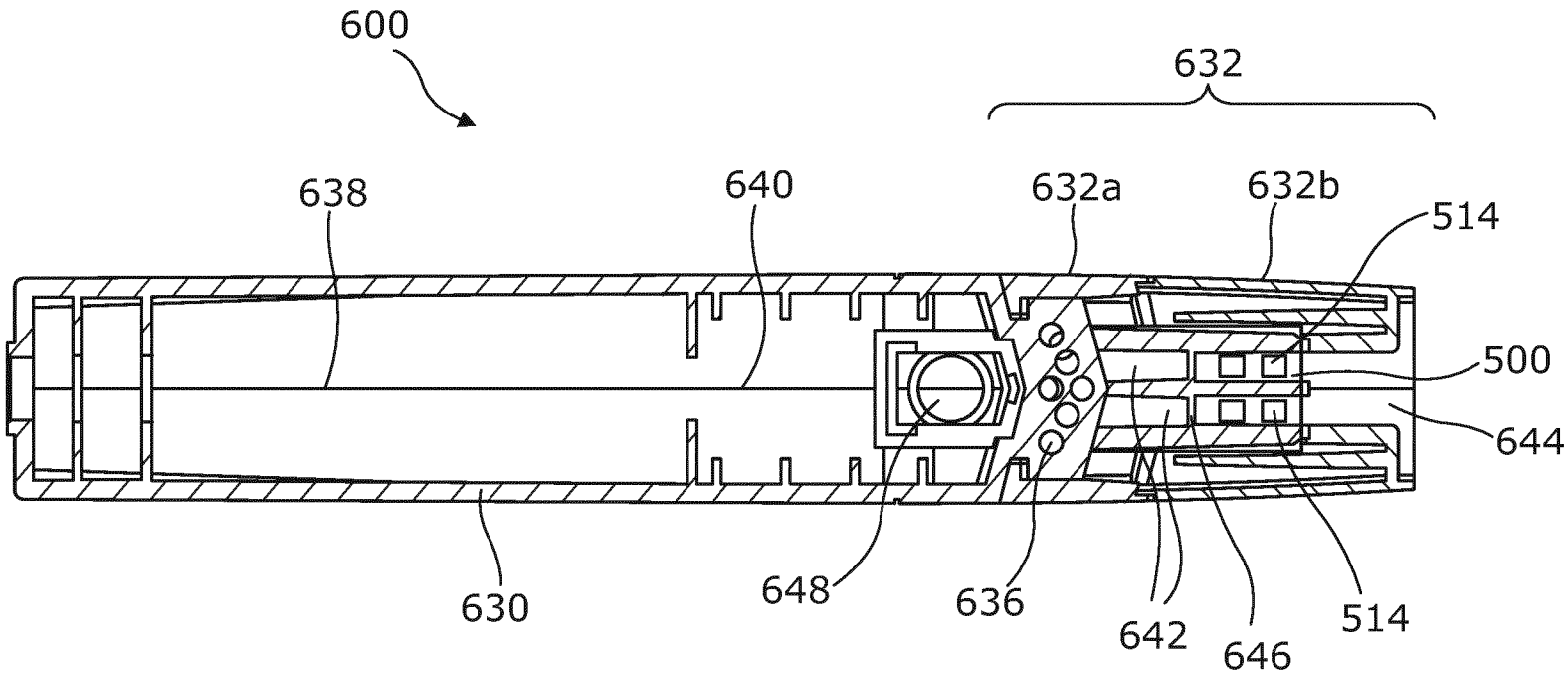
FIG. 8 is a cross-sectional view of the device of FIG. 6 taken along the line A-A in FIG. 6.

FIG. 8 shows a cross-section through inhalation device 600 along the line A-A in FIG. 6. Mouthpiece 632 containing heater 500 is connected to main body part 630. The end of main body part 630 to which mouthpiece 632 is connected comprises a number of contact pins 636 which are arranged to make electrical contact with respective ones of contact pads 513*a*-513*e* of heater 500.

The main body part has a first interior space 638 for accommodating an electric power source (not shown) and a second interior space for containing a control unit (not shown) for controlling electrical activation of resistive element portions 514. Contact pins 636 are connected to the electric power source via the control unit. A button 648 is also provided on the main body part 630 to enable a user to activate the heater 500. Alternatively, the skilled person will appreciate that a sensor responsive to a user's inhalation could be used to activate the heater.

Mouthpiece 632 has channels 642 which overlie resistive element portions 514 when heater 500 is installed in the mouthpiece 632. The channels 642 are in fluid communication with an air inlet (not shown) arranged on the main body part 630 and an air outlet 644 of the mouthpiece 632. A constriction 646 is arranged in channels 642 immediately prior to the resistive element portions 514 to accelerate the airflow and provide a pressure drop in this region of the channel. This assists entrainment of the aerosolized composition in the airflow.

The device 600 of FIGS. 6 to 8 is configured to be highly accurate and to comply with the requirements of the Human Medicines Regulations Such a device is therefore suitable as a nicotine replacement therapy.

In use, a user will seal his lips around the mouthpiece 632 of the inhalation device 600 and inhale. Air is drawn into the air inlet, through channels 642 and over the heater 500 in the region of resistive element portions 514 before exiting the inhalation device via air outlet 644. At the same time as inhaling the user presses button 648 to activate heater 500. Dependent on the dose to be delivered, the control unit will activate one or more of resistive element portions 514 by directing an electric current through these resistive element portions 514 causing them to generate heat. At least a portion of the compositions deposited above the respective one or more resistive element portions is vaporized and forms an aerosolized composition above the heater 500 which becomes entrained in the moving airflow. Since the composition is in direct conductive contact with the heater, aerosolization of the required amount of composition can be achieved at much lower temperatures, i.e. 140° C., compared to conventional wick-and-coil heaters which typically heat to around 300° C. The aerosolized composition is then inhaled by a user via outlet 644. The device then resets in preparation for the next inhalation.

Figure 9A:
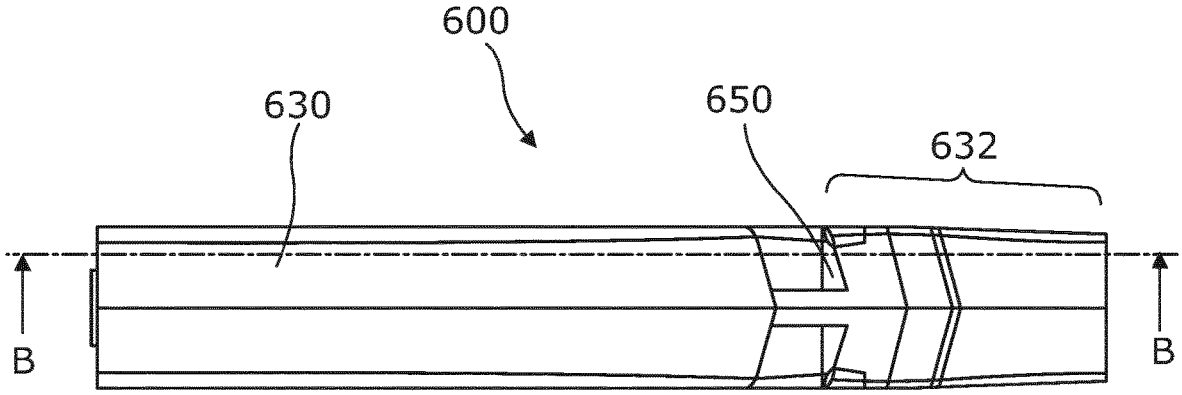
FIG. 9A is a plan view of the inhalation device of FIG. 6.
Figure 9B:
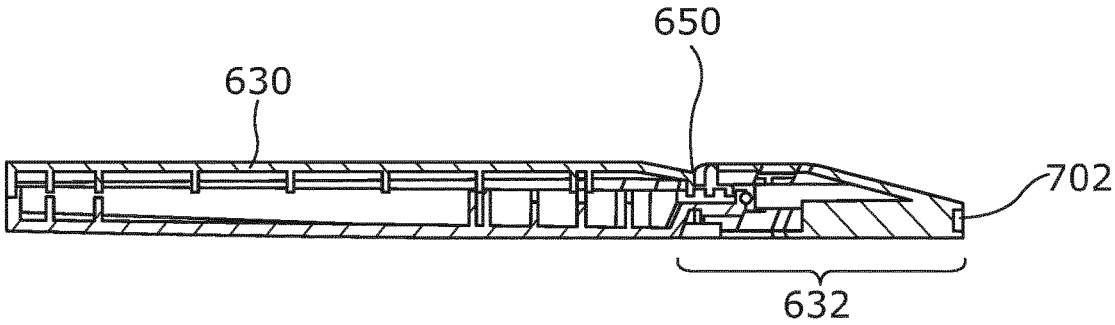
FIG. 9B is a cross-sectional side view of the inhalation device along the line B-B in FIG. 9A.

Referring now to FIGS. 9A and 9B, the inhalation device 600 is shown with air inlet 650 arranged in a top surface of the main body part 630. The air inlet 650 is laterally spaced apart from the central longitudinal axis of the inhalation device 600 and is located in the region where the mouthpiece 632 attaches to the main body part 630. FIG. 9B shows a cross-sectional view through inhalation device 900 along the line B-B in FIG. 9A. The air inlet 650 is in fluid communication with the mouthpiece 632 and air exits the inhalation device 600 via an outlet 702 (part of which is shown in FIG.

9B). An airflow channel passes from the air inlet 650 on the main body part 630 to the outlet 702 of the mouthpiece 632. The main portion of the airflow channel which passes through the mouthpiece 632 is not visible in FIG. 9B because it passes closer to the central longitudinal axis of the device, i.e. in the region of line G-G in FIG. 10A.

Figure 10A:
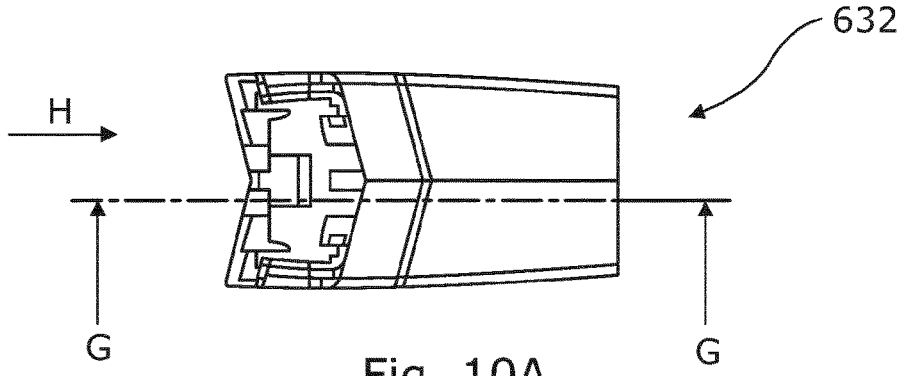
FIG. 10A is a plan view of the mouthpiece according to one or more embodiments of the present invention.
Figure 10B:
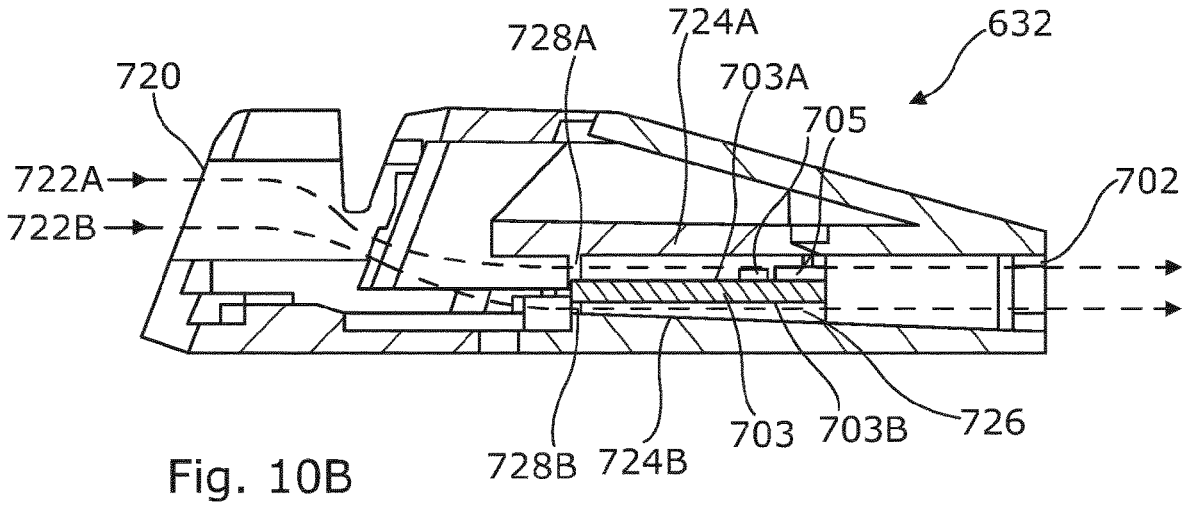
FIG. 10B is a cross-sectional side view of the mouthpiece along the line G-G in FIG. 10A.

Referring to FIG. 10A, this shows a plan view of the mouthpiece 632 alone, i.e. detached from the main body part 630. FIG. 9B shows a cross-sectional view through the mouthpiece along the line G-G in FIG. 10A. Air enters the mouthpiece 632 via an opening 720 at the rear of the mouthpiece 632, which opening 720 is in fluid communication with the air inlet 650 (see FIGS. 9A and 9B). The air flows through the mouthpiece 632 to the outlet 702 via an enclosed airflow channel or fluid passage. The airflow through the airflow channel is denoted by dotted lines 722*a* and 722*b* in FIG. 10B.

A heater 703 is arranged inside the mouthpiece 632 within the airflow channel. In the vicinity of the heater 703, the airflow channel comprises a first airflow channel portion 724*a* and a second airflow channel portion 724*b*. The first airflow channel portion 724*a* is arranged to direct a portion of the airflow (denoted by dotted line 722*a*) past and above the first upwardly facing surface 703*a* of the heater 703 and its the resistive element portions 705. The resistive element portions 705 are located at the downstream end of the heater 703 in the vicinity of or near to the outlet 702 of mouthpiece 632. The second airflow channel portion 724*b* is arranged to direct a portion of the airflow (denoted by dotted line 722*b*) past and beneath the second downwardly facing surface 703*b* of the heater 703. The upper and lower surfaces of the first 724*a* and second 724*b* airflow channel portions respectively are flat to encourage laminar airflow past the resistive element portions 705.

The heater 703 is supported on rails 726 which run parallel to the longitudinal axis of the mouthpiece and hold the heater at a central region within the airflow channel such that air can flow both above and below the heater 703. Protrusions 728*a* and 728*b* extend from the upper and lower surfaces of the first 724*a* and second 724*b* airflow channel portions respectively and contact the heater 703 near its upstream end to assist in holding the heater 703 in place within the mouthpiece 632. Each of protrusions 728*a* and 728*b* has a constriction orifice or channel restriction (not shown in FIG. 10B, see FIG. 10C) passing through it. The purpose of the constriction orifices is to increase resistance to inhalation by restricting the airflow in the region of the protrusions 728*a* and 728*b* and provide a more realistic feel to the inhalation device 600 for smokers of traditional tobacco products. The protrusions 728*a* and 728*b* are located sufficiently upstream of the resistive heater elements 705 such that turbulent air exiting the constriction orifices has space to return to laminar flow by the time it passes over the resistive heater elements 705. Laminar flow assists in inhibiting the aerosolized composition from reaching the surfaces of the airflow channel because the aerosolized composition tends to flow through the device entrained with the streamlined flow.

Figure 10C:
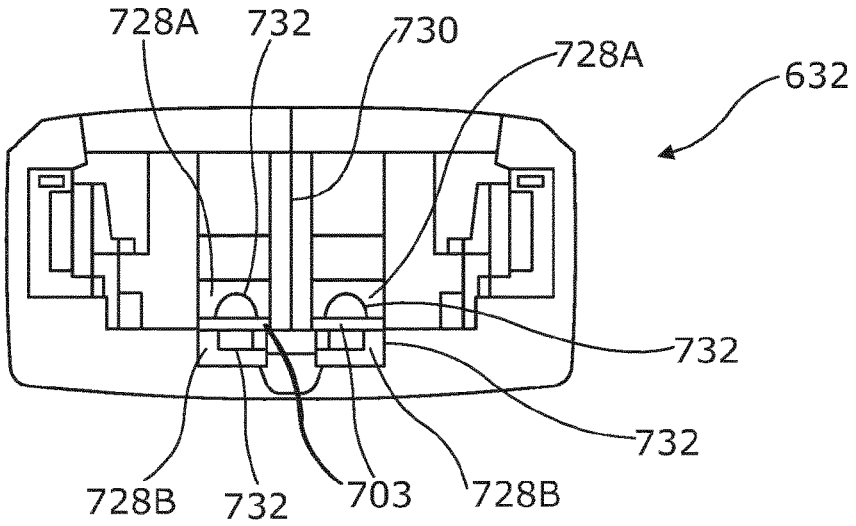
FIG. 10C is a rear view of the mouthpiece viewed in the direction of arrow H in FIG. 10A.

FIG. 10C shows a rear view of the mouthpiece 632, i.e. a view in the direction of arrow H in FIG. 10A. The mouthpiece 632 has a central vertical dividing wall 730 which divides the airflow channel in two. The portion of the mouthpiece 632 to the left of the dividing wall 730 is essentially a mirror image of the portion of the mouthpiece 632 to the right of the dividing wall 730. The left-hand portion of the mouthpiece 632 repeats the features of the mouthpiece 632 to the right of the dividing wall 730.

As can be seen from FIG. 10C, protrusions 728*a* and 728*b* contact the heater 703 to assist in holding it in place within the mouthpiece 632. Each of protrusions 728*a* and 728*b* has a constriction orifice 732 passing through it. The constriction orifice is semi-circular in shape, although any suitable shape can be used. The size or diameter of the constriction orifices 732 is less than the size of the airflow channel in which they are situated in order to restrict the airflow in the region of the protrusions 728*a* and 728*b* as described above.

In use, a user places the mouthpiece 632 in their mouth and inhales through the inhalation device 600. Air flows in through the air inlet 650 and through the airflow channel to the outlet 650 of the mouthpiece 632. A sensor (not shown) may be provided to detect a drop in pressure within the airflow channel and sends a signal to the control circuitry to heat or activate the resistive heater elements 705. However, the skilled person will appreciate that a button (e.g. 648, FIG. 8) pressed by the user could be used instead of a sensor to activate the resistive heater elements 705. Once activated, heat from the resistive heater elements 705 is transferred to a composition overlying the resistive heater elements 705. At least a portion of the composition evaporates to form an aerosolized composition which becomes entrained in the airflow passing over the upper first surface 703*a* of the heater 703 and is inhaled by the user.

Since the resistive heater elements 705 are located at the downstream end of the heater 703 in the vicinity or near to the outlet 702, there is insufficient time and/or insufficient length or surface area of the airflow channel for condensation to form. Consequently, a greater proportion of the nicotine containing composition reaches the user. Furthermore, this arrangement inhibits the formation of condensation droplets within the mouthpiece 632, which can be unpleasant if inhaled by a user.

In the described embodiment, airflow not only passes over the upper surface of the heater 703 but a portion of the airflow channel, i.e. the second airflow channel portion 724*b*, is located below the heater 703. It has been found by the inventors that the lower second airflow channel portion 724*b* may assist in inhibiting condensation of the aerosolized composition on the lower surfaces of the substrate and mouthpiece.

As the user inhales, air has to be drawn through the constriction orifices 732. As discussed above, this increases resistance to inhalation by restricting the airflow and provides a more realistic feel to the inhalation device 100 for smokers of traditional tobacco products. A constriction orifice 732 is located in both the upper first airflow channel portion 724*a* and the lower second airflow channel portion 724*b* so that the upper and lower airflows are restricted equally, i.e. both airflows are travelling at generally the same speed and mass flow rate. This assists in the smooth flow of air through the device, which further inhibits the formation of condensation.

The present invention may be further exemplified by one, or a combination of one or more of, the following statements:

1. A heater for an inhalation device, the heater being configured to heat a composition to generate an aerosolized composition for inhalation by a user, the heater comprising:

a substrate; and at least one resistive heater element supported by the substrate, wherein the at least one resistive heater is arranged to be connectable to an electric power source.

2. A heater according to statement 1 above, wherein the heater further comprises a barrier layer for inhibiting undesirable by-products generated during the heating of the at least one resistive heater element from mixing with the composition. In an alternative arrangement, the substrate itself may be configured as the barrier layer. In this latter arrangement, the at least one resistive heater element is supported by a first surface of the substrate and an opposing second surface of the substrate is arranged for receiving a composition.

3. A heater according to statement 2 above, wherein the barrier layer is arranged to overly at least a portion of the at least one resistive heater element. The barrier layer and/or the substrate may be formed of a material selected from one or more of a ceramic, a plastic and glass, and the substrate may be rigid, and may additionally comprise one or more indentations in the region surrounding the at least one resistive heater element or plurality of resistive heater elements. The indentations may be formed by laser cutting.

4. A heater according to any one of statements 1-3 above further comprising at least two contacts supported by the substrate, wherein a first end of each of the at least two contacts is connected to the resistive heater element and a second end of each of the at least two contacts is arranged to be connectable to an electric power source. Either or both of said resistive heater element and the at least two contacts may be printed on the substrate, optionally as a film (thick or thin), optionally by printing, optionally in a single print run, for example by screen printing. Additionally, the at least one resistive heater element and contacts may be formed of the same material, with the at least one resistive heater having a smaller cross-sectional area than the contacts such that it has a higher resistance. When printed in a single print run, a part of the material deposited may be ablated, for example by laser etching, to form resistive heater element having a region of reduced cross-sectional area such that the region of reduced cross-sectional area has a relatively higher resistance than the remainder of the material. Alternatively, the resistive heater element and contacts comprise different materials and are deposited on the substrate using separate print runs.

5. A heater according to statement 4 above wherein the at least one resistive heater element has a length longer than the straight-line distance between the points where the at least one resistive heater element is connected to the contacts. Additionally, the at least one resistive heater element may follow a meandering path between the contacts, which in certain embodiments may be formed of different materials. For example, the at least one resistive heater element may comprise any one or more of the following: carbon, silver, ruthenium, palladium.

6. A heater according to any one of the statements wherein the heater comprises a plurality of resistive heater elements and a corresponding number of contacts. For example, a contact may be provided for each of the plurality of resistive heater elements and a further contact may be provided to form a common ground for each of the plurality of resistive heater elements.

7. A heater according to any one of the preceding statements, wherein either the at least one resistive heater element or at least one of the contacts has a region of reduced cross-sectional area which acts as a fuse which fails if the electric current flowing through the reduced cross-sectional area region exceeds a certain threshold value.

8. A heater according to any one of the preceding statements, further comprising a composition supported by the barrier layer or the substrate as the case may be. The composition may comprise nicotine, and may be deposited on the barrier layer or substrate by printing.

9. A heater according to any one of the preceding statements, wherein the resistive heater element has a resistance of between 5 ohms and 15 ohms at a temperature of 130° C.

10. A mouthpiece for an inhalation device, the mouthpiece comprising the heater as prescribed in any one of the preceding statements.

11. An inhalation device comprising the mouthpiece as prescribed in statement 10 and including a main body part which comprises a power source for the device and a control unit.

12. An inhalation device comprising a heater configured to heat a composition to generate an aerosolized composition for inhalation by a user; and an airflow channel passing through at least a portion of the device and arranged to receive the aerosolized composition; wherein the heater is arranged in the vicinity of an outlet of the airflow channel.

13. An inhalation device according to statement 12 wherein the heater is arranged within an interior of the airflow channel, which may comprise rails for holding the heater within the interior of the airflow channel. Said rails may hold the heater at a central region within the airflow channel.

14. An inhalation device according to either of statements 12 or 13, wherein the heater comprises a substrate having opposing first and second surfaces, the first surface supporting at least one resistive heater element.

15. An inhalation device according to statement 14 wherein the airflow channel and the heater are arranged such that an airflow is directed past at least the first surface of the substrate supporting the at least one resistive heater element. The airflow channel in the vicinity of the heater may comprise a first airflow channel portion which is arranged to direct an airflow past the first surface of the substrate and a second airflow channel which is arranged to direct an airflow past the second surface of the substrate. The first and/or second airflow channel portion may be defined by at least one flat surface, and a constriction orifice may be provided within the airflow channel for restricting the flow of air within the airflow channel in the region of the constriction orifice. The constriction orifice may be located upstream of the at least one resistive heater element, and both the first and second airflow channel portions may comprise such a constriction orifice.

16. An inhalation device according to any one of statements 12-15 further comprising a mouthpiece, wherein the mouthpiece comprises the outlet of the airflow channel. At least a portion of the heater or the entire heater may be arranged within the mouthpiece. The inhalation device may further comprise a main body part to which the mouthpiece may be releasably attachable. The main body part may comprise an inlet of the airflow channel, which may be located in the region where the mouthpiece attaches to the main body part. The length of the mouthpiece may be less than half, or less than a third, of the overall length of the device.

Various modifications will be apparent to those skilled in the art. For example, the resistive element portions, contacts and compositions could be deposited by a process other than screen printing, for example, by inkjet printing or 3D printing. Additionally pellets comprising a composition could be supported by or attached to the heater. Upon the application of heat the pellets melt and release a composition which is aerosolized.

As used herein any reference to "one embodiment" or "an embodiment" means that a particular element, feature, structure, or characteristic described in connection with the embodiment is included in at least one embodiment. The appearances of the phrase "in one embodiment" or the phrase "in an embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the invention. This is done merely for convenience and to give a general sense of the invention. This description should be read to include one or at least one and the singular also includes the plural unless it is obvious that it is meant otherwise.

In view of the foregoing description it will be evident to a person skilled in the art that various modifications may be made within the scope of the invention.

The scope of the present disclosure includes any novel feature or combination of features disclosed therein either explicitly or implicitly or any generalization thereof irrespective of whether or not it relates to the claimed invention or mitigate against any or all of the problems addressed by the present invention. The applicant hereby gives notice that new claims may be formulated to such features during prosecution of this application or of any such further application derived therefrom. In particular, with reference to the appended claims, features from dependent claims may be combined with those of the independent claims and features from respective independent claims may be combined in any appropriate manner and not merely in specific combinations enumerated in the claims.

The invention claimed is:

1. An assembly for an inhalation device comprising:

a mouthpiece; and a heater including a substrate which supports:

at least one resistive element portion applied over a first region of at least one surface of the substrate;

at least a pair of contacts each connected to the at least one resistive element portion at one end of the contacts and applied over a second region of the at least one surface of the substrate, wherein the first region is proximate a forward or leading edge of the substrate, and the second region is proximate a rearward or trailing edge of the substrate; and an amount of an aerosolizable composition deposited on the substrate above the first region on the at least one surface of the substrate or deposited on a surface opposite the at least one surface of the substrate, such that heat generated by the at least one resistive element portion is directly or indirectly conducted to the aerosolizable composition to cause at least some aerosolization of the aerosolizable composition;

wherein the mouthpiece has:

a fluid inlet at an upstream rear end thereof;

a fluid outlet at a downstream front end thereof; and fluid communication means internal to the mouthpiece between the fluid inlet and the fluid outlet;

wherein the heater is disposed substantially within the mouthpiece in or adjacent the fluid communication means and arranged such that the substrate leading edge is proximate the mouthpiece fluid outlet and the substrate trailing edge is substantially adjacent the rear end of the mouthpiece such that at least portions of the contacts are both exposed and accessible towards the rear end of the mouthpiece, and such that when fluid is flowing through the fluid communication means and aerosolization is simultaneously occurring, aerosol is generated which is entrained in the fluid flowing within the mouthpiece through the fluid communication means;

wherein the mouthpiece includes first and second parts, the first mouthpiece part having a slot which receives the heater which is held in place within the mouthpiece when the second mouthpiece part is attached to the first mouthpiece part, the entire assembly being releasably attachable to a main body part of the inhalation device at the rear end of the mouthpiece; and wherein an electrical connection with the exposed accessible contacts is achieved when the mouthpiece rear end is attached to the main body part.

2. The assembly according to claim 1, wherein the substrate supports a plurality of resistive element portions and a corresponding number of pairs of contacts connected thereto.

3. The assembly according to claim 2, wherein the heater is supported within the mouthpiece by rails which run parallel to a longitudinal axis of the mouthpiece and which hold the heater at a central region within the fluid communication means such that air flows both above and below the heater.

4. The assembly according to claim 2, wherein the mouthpiece has a central vertical dividing wall which vertically divides the fluid communication means internal to the mouthpiece into two separate airflow channels.

5. The assembly according to claim 3, wherein the mouthpiece has a central vertical dividing wall which vertically divides the fluid communication means internal to the mouthpiece into two separate airflow channels.

6. The assembly according to claim 1, wherein the aerosolizable composition is deposited on the same surface of the substrate as that to which the at least one resistive element portion of the heater has been applied.

7. The assembly according to claim 1, wherein the aerosolizable composition is deposited on the surface of the substrate opposite to that to which the at least one resistive element portion of the heater has been applied.

8. The assembly according to claim 2, wherein the aerosolizable composition is deposited on the surface of the substrate opposite to that to which the at least one resistive element portion of the heater has been applied.

9. The assembly according to claim 3, wherein the aerosolizable composition is deposited on the surface of the substrate opposite to that to which the at least one resistive element portion of the heater has been applied.

10. The assembly according to claim 4, wherein the aerosolizable composition is deposited on the surface of the substrate opposite to that to which the at least one resistive element portion of the heater has been applied.

11. The assembly according to claim 6, wherein the at least one resistive element portion of the heater is covered by a barrier layer.

12. The assembly according to claim 11, wherein the barrier layer is formed of a material selected from at least one of: a ceramic, a plastic and glass.

13. The assembly according to claim 1, wherein the at least one resistive element portion follows meandering paths between points wherein each at least one resistive element is connected to a respective contact.

14. The assembly according to claim 1, wherein the at least one resistive element portion has a resistance of between 5 ohms and 15 ohms at a temperature of 130° C.

15. The assembly according to claim 2, wherein the heater includes:

a first contact for each of the plurality of resistive element portions; and a second contact which forms a common ground for each of the plurality of resistive elements portions and which acts as the alternate common contact in the pair of contacts between which each resistive element portion is connected.

16. The assembly of claim 1, wherein the main body part of the inhalation device includes:

a power source for the inhalation device; and a control unit.

17. An inhalation device comprising:

a mouthpiece; and a heater including a substrate which supports:

at least one resistive element portion applied over a first region of at least one surface of the substrate;

at least a pair of contacts each connected to the at least one resistive element portion at one end of the contacts and applied over a second region of the at least one surface of the substrate, wherein the first region is proximate a forward or leading edge of the substrate, and the second region is proximate a rearward or trailing edge of the substrate; and an amount of an aerosolizable composition deposited on the substrate above the first region on the at least one surface of the substrate or deposited on a surface opposite the at least one surface of the substrate, such that heat generated by the at least one resistive element portion is directly or indirectly conducted to the aerosolizable composition to cause at least some aerosolization of the aerosolizable composition;

wherein the mouthpiece has:

a fluid inlet at an upstream rear end thereof;

a fluid outlet at a downstream front end thereof; and fluid communication means internal to the mouthpiece between the fluid inlet and the fluid outlet;

wherein the heater is disposed substantially within the mouthpiece in or adjacent the fluid communication means and arranged such that the substrate leading edge is proximate the mouthpiece fluid outlet and the substrate trailing edge is substantially adjacent the rear end of the mouthpiece such that at least portions of the contacts are both exposed and accessible towards the rear end of the mouthpiece, and such that when fluid is flowing through the fluid communication means and aerosolization is simultaneously occurring, aerosol is generated which is entrained in the fluid flowing within the mouthpiece through the fluid communication means;

wherein the mouthpiece includes first and second parts, the first mouthpiece part having a slot which receives the heater which is held in place within the mouthpiece when the second mouthpiece part is attached to the first mouthpiece part, the entire assembly being releasably attachable to a main body part of the inhalation device at the rear end of the mouthpiece; and wherein an electrical connection with the exposed accessible contacts is achieved when the mouthpiece rear end is attached to the main body part.

18. The inhalation device according to claim 17, wherein the at least one resistive element portion has a resistance of between 5 ohms and 15 ohms at a temperature of 130° C.

19. The inhalation device comprising:

a main body part;

a mouthpiece; and a heater including:

a substrate;

at least one resistive element portion applied over a first region of at least one surface of the substrate;

at least a pair of contacts each connected to the at least one resistive element portion at one end of the contacts and applied over a second region of the at least one surface of the substrate, wherein the first region is proximate a forward or leading edge of the substrate, and the second region is proximate a rearward or trailing edge of the substrate; and an amount of an aerosolizable composition deposited on the substrate above the first region on the at least one surface of the substrate or deposited on a surface opposite the at least one surface of the substrate, such that heat generated by the at least one resistive element portion is directly or indirectly conducted to the aerosolizable composition to cause at least some aerosolization of the aerosolizable composition;

wherein the mouthpiece has:

a fluid inlet at an upstream rear end thereof;

a fluid outlet at a downstream front end thereof; and fluid communication means internal to the mouthpiece between the fluid inlet and the fluid outlet;

wherein the heater is disposed substantially within the mouthpiece in or adjacent the fluid communication means and arranged such that the substrate leading edge is proximate the mouthpiece fluid outlet and the substrate trailing edge is substantially adjacent the rear end of the mouthpiece such that at least portions of the contacts are both exposed and accessible towards the rear end of the mouthpiece, and such that when fluid is flowing through the fluid communication means and aerosolization is simultaneously occurring, aerosol is generated which is entrained in the fluid flowing within the mouthpiece through the fluid communication means;

wherein the mouthpiece includes first and second parts, the first mouthpiece part having a slot which receives the heater which is held in place within the mouthpiece when the second mouthpiece part is attached to the first mouthpiece part, the entire assembly being releasably attachable to the main body part at the rear end of the mouthpiece; and wherein an electrical connection with the exposed accessible contacts is achieved when the mouthpiece rear end is attached to the main body part.

20. The inhalation device according to claim 19, wherein the at least one resistive element portion has a resistance of between 5 ohms and 15 ohms at a temperature of 130° C.

* * * * *